US007458569B2

(12) United States Patent
Steinhilber

(10) Patent No.: US 7,458,569 B2
(45) Date of Patent: Dec. 2, 2008

(54) DEVICE FOR SEPARATING THE INDIVIDUAL SHEETS OF A PRINT MEDIUM

(75) Inventor: Helmut Steinhilber, deceased, late of Hergiswil (CH); by Karl-Heinz Niggemann, legal representative, Rottweil (DE)

(73) Assignee: BDT AG, Rottweil (DE)

( * ) Notice: Subject to any disclaimer, the term of this patent is extended or adjusted under 35 U.S.C. 154(b) by 464 days.

(21) Appl. No.: 11/115,638

(22) Filed: Apr. 27, 2005

(65) Prior Publication Data

US 2007/0001365 A1 Jan. 4, 2007

(30) Foreign Application Priority Data

May 3, 2004 (DE) ..... 10 2004 022 010

(51) Int. Cl.
*B65H 5/00* (2006.01)

(52) U.S. Cl. ..... 271/10.01; 271/106; 271/34; 271/37; 271/42

(58) Field of Classification Search ..... 271/10.01, 271/10.06, 106, 34, 37, 42
See application file for complete search history.

(56) References Cited

U.S. PATENT DOCUMENTS

| | | | | |
|---|---|---|---|---|
| 5,785,309 | A | 7/1998 | Halup et al. | 271/11 |
| 6,332,607 | B1 * | 12/2001 | Van Der Werff | 271/101 |
| 6,663,097 | B2 | 12/2003 | Bantle | 271/34 |
| 6,779,793 | B2 * | 8/2004 | Behrens et al. | 271/283 |
| 2005/0040582 | A1 * | 2/2005 | Steinhilber | 271/42 |

FOREIGN PATENT DOCUMENTS

DE 100 16 793 C2 7/2002

* cited by examiner

*Primary Examiner*—David H Bollinger
(74) *Attorney, Agent, or Firm*—Baker Botts L.L.P.

(57) ABSTRACT

Sheets (12, 14) of a print medium kept in a stack (10) are individually fed into an office machine. The edge of the uppermost sheet (12) is raised off the corresponding edge of the following second sheet (14). At least one band (32) is then inserted into the gap formed in this way, which separates the uppermost sheet (12) from the following sheet (14), reducing thereby the friction between the uppermost sheet (12) and the following sheet (14) when the uppermost sheet (12) is pulled off, and minimizing thereby any electrostatic charge of the sheets (12, 14) caused by such friction. The band (32) can be retracted into a band housing (36).

13 Claims, 3 Drawing Sheets

DEVICE FOR SEPARATING THE INDIVIDUAL SHEETS OF A PRINT MEDIUM

PRIORITY

This application claims priority to German application no. 10 2004 022 010.7 filed May 3, 2004.

TECHNICAL FIELD OF THE INVENTION

The invention concerns a device for separating the individual sheets of a print medium.

DESCRIPTION OF RELATED ART AND BACKGROUND OF THE INVENTION

Normally, print media in sheet-form are used for office machines and similar equipment such as copiers, printers etc. These print media, normally sheets of paper, are kept in a stack from which individual sheets are pulled and fed into the office machine. Pulling off the uppermost sheet from the stack creates friction between that uppermost sheet and the following sheet resulting in an electrostatic charge of the sheets as they rub against each other. This electrostatic charge depends on the environmental conditions at that moment such as temperature and air humidity as well as the surface and material properties of the sheets. The electrostatic charge causes the sheets to cling together and can make it quite difficult to separate the uppermost sheet of the stack.

SUMMARY OF THE INVENTION

The purpose of the invention is to reduce the deleterious influence of the electrostatic charge when pulling individual sheets from the stack.

This purpose can be achieved by a device for separating individual sheets of a print medium to be fed into an office machine or similar equipment in which sheets are kept in a stack, comprising a device for raising at least one edge of an uppermost sheet of the stack from a following sheet of the stack, a device for pulling the uppermost sheet off the stack, a device for feeding the pulled sheet into the office machine, and at least one separating element in the shape of a band which can be moved into a gap created between the raised edge of the uppermost sheet and a corresponding edge of the following sheet and can be inserted between the uppermost sheet and the following sheet, and which can be retracted into a band housing.

A leading edge of the uppermost sheet pointing in the direction it is pulled off can be raised off the following sheet, there can be at least one band housing in front of the leading edge of the stack pointing in the direction it is pulled, and at least one band can be inserted against the direction it is pulled off between the uppermost sheet and the following sheet. An advance mechanism may engage the uppermost sheet and move the uppermost sheet against at least one endlessly circulating belt which raises the edge of the uppermost sheet. The band can be a steel band of low material strength whose cross-section profile results in an axial stiffening of the band. The band may have a tip that glides smoothly. At least one band can be sufficiently long to be inserted across the entire length of the stack in the direction it is pulled off. There can be two bands on both sides of the device for raising the uppermost sheet and located at a certain distance from it. At least one band can be electrically conductive or may have an electrically conductive coating and is grounded. The perimeter area of the band housing may have little gliding resistance.

The perimeter area of the band housing can be formed by a ring of rolls that can be rotated freely. At least one band can be retracted into the band housing on a coaxial band core. A band core or band cores may rest on a mechanically driven shaft. At least one grasping element on the side of the stack pointing into the direction it is pulled can be moved between the raised edge of the uppermost sheet and the following sheet and there can be at least one grasping element that is offset vertically to the direction it is pulled against the at least one band.

The main thinking behind the invention is to introduce at least one band-shaped separating element between the uppermost sheet and the following second sheet of the stack when pulling off individual sheets before the uppermost sheet is pulled off. The separating element detaches the uppermost sheet from the surface of the following sheet, reducing thereby the friction between the uppermost sheet and the following sheet when the former is pulled off. The separating element takes the form of a long band that is inserted between the sheets through the gap created between the edge of the uppermost sheet and the following sheet. The band may be long enough to extend across the entire length of the sheets to be separated. In the process the band detaches the uppermost sheet from the following sheet across its entire length. In order to achieve an optimal separation also across the width of the sheet, it is advantageous to use two bands, and if necessary more than two bands, which are inserted side by side, in parallel and evenly distributed across the width of the stack. This ensures that the uppermost sheet is essentially detached from the following sheet across its entire area. When the uppermost sheet is pulled off, it essentially comes to rest on the bands, avoiding thereby any touching and friction between the two sheets.

In order to make it possible for the band-shaped separating element to be inserted across as much of the length of the sheet as possible, the band must have a suitable length. To make sure that the band takes little space when in its original position outside the stack, the band is mounted inside the band housing in a spiral. The inner perimeter of the band housing on which the band rests and which forms the track for the band as it uncoils and recoils is low-friction, making it possible to extend or retract the band with little gliding resistance. This allows the band to be dispensed from the band housing and inserted into the stack at high speed, and to be rapidly rewound when it is retracted from the stack. The separation of the individual sheets can therefore be achieved at high speed.

This band, one being the minimum, allows for the uppermost sheet to be lifted off the following sheet at least in certain areas, allowing air to enter between the uppermost sheet and the following sheet. The air serves as a cushion on which the uppermost sheet, as it is pulled off, can glide as if floating and with little friction. In a preferred embodiment the uppermost sheet is separated from the following sheet practically across its entire surface with the help of the band, one being the minimum. This almost completely reduces the friction between the uppermost sheet and the following sheet as the former is pulled off, minimizing the electrostatic charge caused by friction. Considering the possibility of a residual charge, in an advantageous embodiment the band, one being the minimum, is electrically conductive and grounded. Any electrostatic charge that might occur is thereby dissipated via the band or bands. For this purpose the band may be made of an electrically conductive metal or have an electrically conductive metallic surface coating.

In a preferred embodiment the separating element is a metal band, in particular a steel band.

This band may have low material strength, resulting in a small mass inertia for the separating element. By bending the cross-section profile of the band, the band can be kept sufficiently stiff even at low material strength as is known from steel band measuring tapes. The small mass and the stiffness of the band make it possible for the band to be mechanically inserted between the sheets at high speed without slowing down or disrupting the sheet-separating cycle when the bands are inserted.

If the band has sufficient stiffness for it to be inserted into the stack across a greater length, the stiffness has the effect that the band rewound in the band housing rests with a certain radial pressure on the interior perimeter of the band housing that forms the track for extending and retracting the band. To avoid the creation of friction due to this radial pressure that could hinder the movement of the band, in a preferred embodiment the band housing has the form of a roller ring. The roller ring consists of freely rotating rolls mounted on the outer surface of the band housing. The retracted band in the band housing touches thus the outer perimeter only at the freely rotating rolls of the roller ring, avoiding thereby practically all gliding friction between the band and the band housing.

It is useful to have the band, one being the minimum, wound on a band core in the bad housing, with this band core taking the form of a shaft that can be rotated by a drive. If more bands are used, they can be driven via the same shaft. The driven band core pushes and dispenses the band from the band housing and retracts it into the band housing. To have the interior perimeter of the band housing take the form of a roller ring is of special advantage when the band is pushed out of the band housing because this push increases the radial pressure of the band against the interior perimeter.

The method according to the invention can be used for all known sheet separations in which the uppermost sheet is initially lifted off the following sheet at one of the edges, creating thereby at this edge a space between the uppermost sheet and the following sheet into which the separating element can be inserted.

BRIEF DESCRIPTION OF THE DRAWINGS

In what follows the invention is explained in more detail with the help of an example of embodiment shown in the following illustrations, namely.

DETAILED DESCRIPTION OF THE PREFERRED EMBODIMENTS

Figure 1:
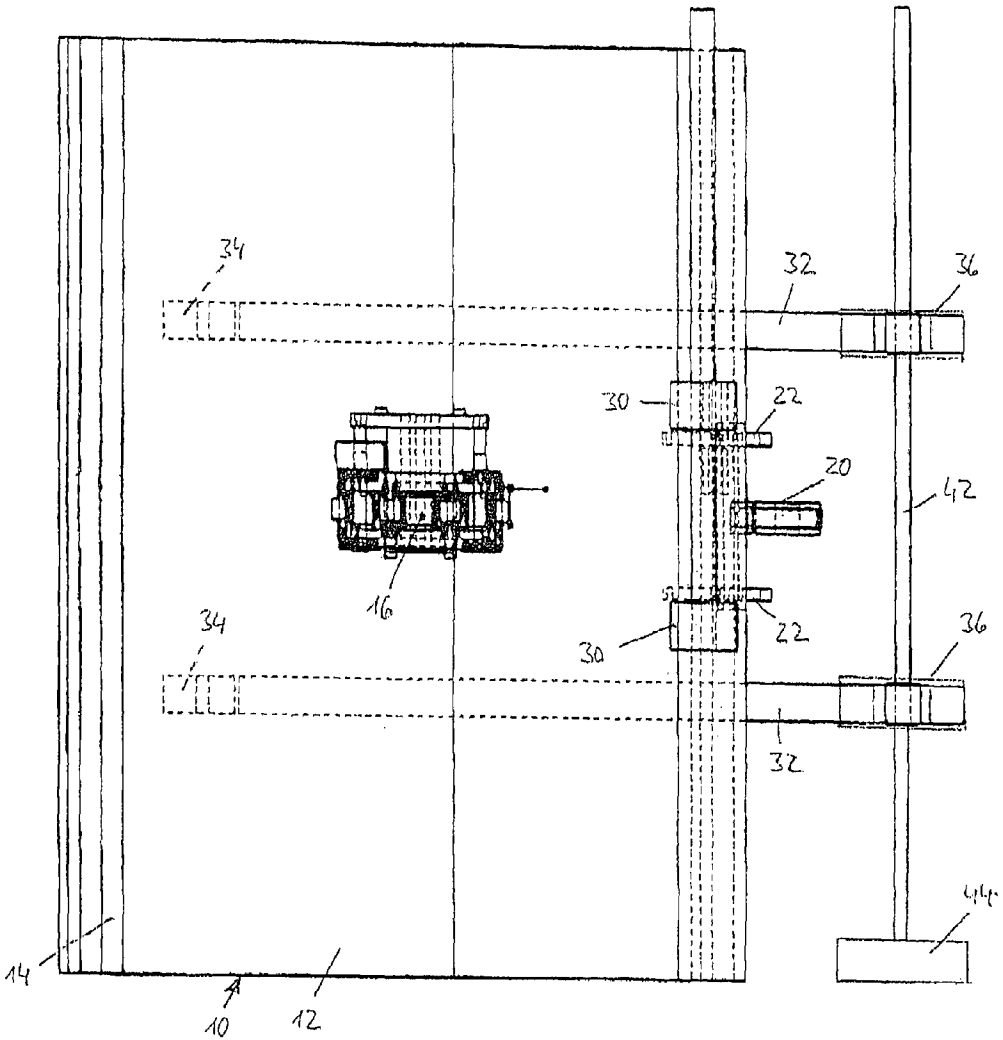
FIG. 1 shows a top view of a sheet separation device.

In order to feed sheets of a print medium, e.g. paper sheets, into an office machine, e.g. a printer or copier, the sheets are arranged in a stack 10. Each uppermost sheet 12 of the stack 10 is lifted individually off the following second sheet 14 of the stack and fed into the office machine, not shown in the illustration.

If a sheet is to be fed in, an advance mechanism 16 is on command placed on the uppermost sheet 12 of the stack 10. This advance mechanism 16 in the shown example of embodiment is a crimping device such as described e.g. in DE 100 16 793 C2. The advance mechanism 16 has freely rotating crimping rolls 18 on endless-loop belts that are moved across the uppermost sheet 12 under pressure in the direction of the sheet advance mechanism, i.e. in the illustration from left to right. In the process the crimping rolls 18 exert a crimping effect on the uppermost sheet 12 which becomes weaker on the following sheets of the stack. This crimping effect advances the upper sheets 12, 14 etc. of the stack 10 so that they overlap, i.e. the uppermost sheet 12 is advanced most, the following sheets 14 etc. less so. This fan-shaped overlap of the upper sheets in the stack 10 is clearly shown in the illustration.

A sheet backstop is located in the direction of the advance of the sheets 12, 14 etc. in front of the stack 10 against which the sheets are moved by the advance mechanism 16. In the example of embodiment per illustration the sheet backstop consists of an endlessly circulating belt 20. The belt 20 in the illustration circulates clockwise, with the seam of the belt 20 facing the stack 10 running essentially vertically upward in front of the upper edge of the stack 10.

Because of the fan-like overlap of the upper sheets of the stack 10 caused by the advance mechanism 16, the leading edge of the uppermost sheet 12, i.e. in the illustration its right edge, reaches the belt 20 first. Since under the pressure exerted by the advance mechanism 16 the leading edge of the uppermost sheet 12 touches the ascending seam of the belt 20.

This leading edge of the uppermost sheet 12 is carried upward by the belt 20 and lifted off the leading edge of the following sheet 14. The ascending seam of the belt 20 is slightly offset vertically and inclined at its upper end toward the stack 10. In this way the leading edge of the uppermost sheet 12 touches the belt 20 under the pressure of the advance mechanism even as the leading edge of the uppermost sheet 12 moves upward.

There is a grasping element 22 on either side of the belt 20 and at a distance from this belt 20 in the direction of the leading edge of the stack 10. The grasping element 22 has the shape of a hook that can be rotated around an axis 24 parallel to the leading edge of the stack 10. The free end of the grasping element 22 takes the form of a finger 26 that points toward the stack 10 and constitutes the center in an arc shape with regard to the axis 24. The grasping element 22 can be rotated around the axis 24 from a rest position, in which its finger 26 is outside and in front of the stack 10, to the actuated position shown in FIGS. 2 and 3. In this actuated position the finger 26 engages between the leading edge of the uppermost sheet 12 raised with the help of the belt 20 and the following sheet 14 lying on the stack 10. The finger 26 of the grasping element 22 rests on the following sheet 14 with its free tip and keeps it tight on the stack 10.

On the top of the finger 26 of the grasping element 22 there is one pressure roll 28 each that can be freely rotated. In the pivoted actuated position shown in FIGS. 2 and 3 the pressure rolls 28 engage the underside of the uppermost sheet 12 and push this uppermost sheet 12 against puller rolls 30 that can be mechanically driven. The leading edge of the uppermost sheet 12 is thus squeezed between the puller rolls 30 and the pressure rolls 28 and lifted off the stack 10 via the driven pressure rolls 28 and forwarded to the office machine.

The device described in what follows helps to prevent that, when the uppermost sheet 12 is pulled off the stack 10, the friction between the uppermost sheet 12 and the following sheet 14 causes an electrostatic charge of these sheets 12 and 14 and thus makes these sheets cling to each other electrostatically.

One or more separating elements are placed in front of the edge of the stack 10 on the side where the sheets are pulled off. The separating elements take the form of long bands 32. Preferably one band 32 is arranged sideways outside of each grasping element 22. The bands 32 are preferably narrow steel bands with low material strength whose cross-section profile is slightly curved in order to give the steel bands the necessary axial stiffness. Such steel bands are used for example as measuring tapes. The end of the bands 32 oriented toward the stack 10 can have a smoothly gliding tip 34, e.g. made of plastic, felt or the like, in order to prevent the bands 32 from damaging the sheets.

Each band 32 is contained in a band housing 36 that has the shape of a flat circular cylinder and is located in front of the leading edge of the stack 10 with an axis parallel to this leading edge. The band housing 36 takes the form of a roller ring consisting of rolls 38. The rolls 38 are mounted evenly on the perimeter of the band housing 36. The rolls 38, which are preferably long rolls, are mounted on an axis parallel to the axis of the band housing 36 and can be rotated freely.

The axial length of the rolls 38 corresponds essentially to the width of the band 32. A band core 40 is mounted coaxially in the band housing 36 so that it can be rotated freely. The band cores 40 of the two band housings 36 rest on a common shaft 42 that can be actuated by an electrical motor 44. The ends of the bands 32 facing away from the stack are attached to the band core 40 and can be retracted into the band housing 36 through a suitably actuated rotation of the band core (in the FIG. 2 and 3 counterclockwise) and wound up spirally on the band core 40. The band 32 then takes on the resting position shown in FIG. 2 in which the band 32 is coiled up in the band housing 36 with its tip 34 being outside of the stack 10 in front of its leading edge.

If the band cores 40 are actuated in the opposite sense of rotation (in the FIG. 2 and 3 clockwise) via the motor 44, the bands 32 are pushed out of their respective band housings 36 and inserted between the raised uppermost sheet 12 and the following second sheet 14 held down by the grasping element 22.

The band housings 36 are therefore mounted in regard to the upper edge of the stack 10 in such a way that the bands 32 pushed out of the band housings 36 are extended parallel to the surface of the stack. The length of the bands 33 is dimensioned in such a way that the tips 34 of the bands 32, when advanced as much as possible toward the stack 10, i.e. in the illustration to the left, reach all the way to the back edge of the stack 10. By suitably controlling the electrical motor 44, which e.g. can take the form of a stepping motor, the extended length of the bands 32 can be specified and adjusted e.g. to the sheet length of the stack 10.

The stiffness and elastic flexibility of the bands 32 has the effect that the bands 32 in their retracted state exert a radial pressure touching the interior perimeter of the band housing 36 and thus the rolls 38. This radial pressure intensifies, in particular when the bands 32 are extended as they are advanced by the mechanically driven band core 40. The freely rotatable rolls 38 have the effect that, in spite of this radial pressure, the bands 32 can be extended from the band housing 36 reliably and without undesirable friction.

The advance mechanism 16 is actuated in response to a sheet request signal and placed on the uppermost sheet 12 of the stack 10. The uppermost sheet 12 is advanced against the belt 20 by the advance mechanism 16. The ascending belt 20 raises the leading edge of the uppermost sheet 12 off the staggered next leading edge of the following sheet 14, creating a gap between the leading edge of the uppermost sheet 12 and the leading edge of the following sheet 14.

Figure 2:
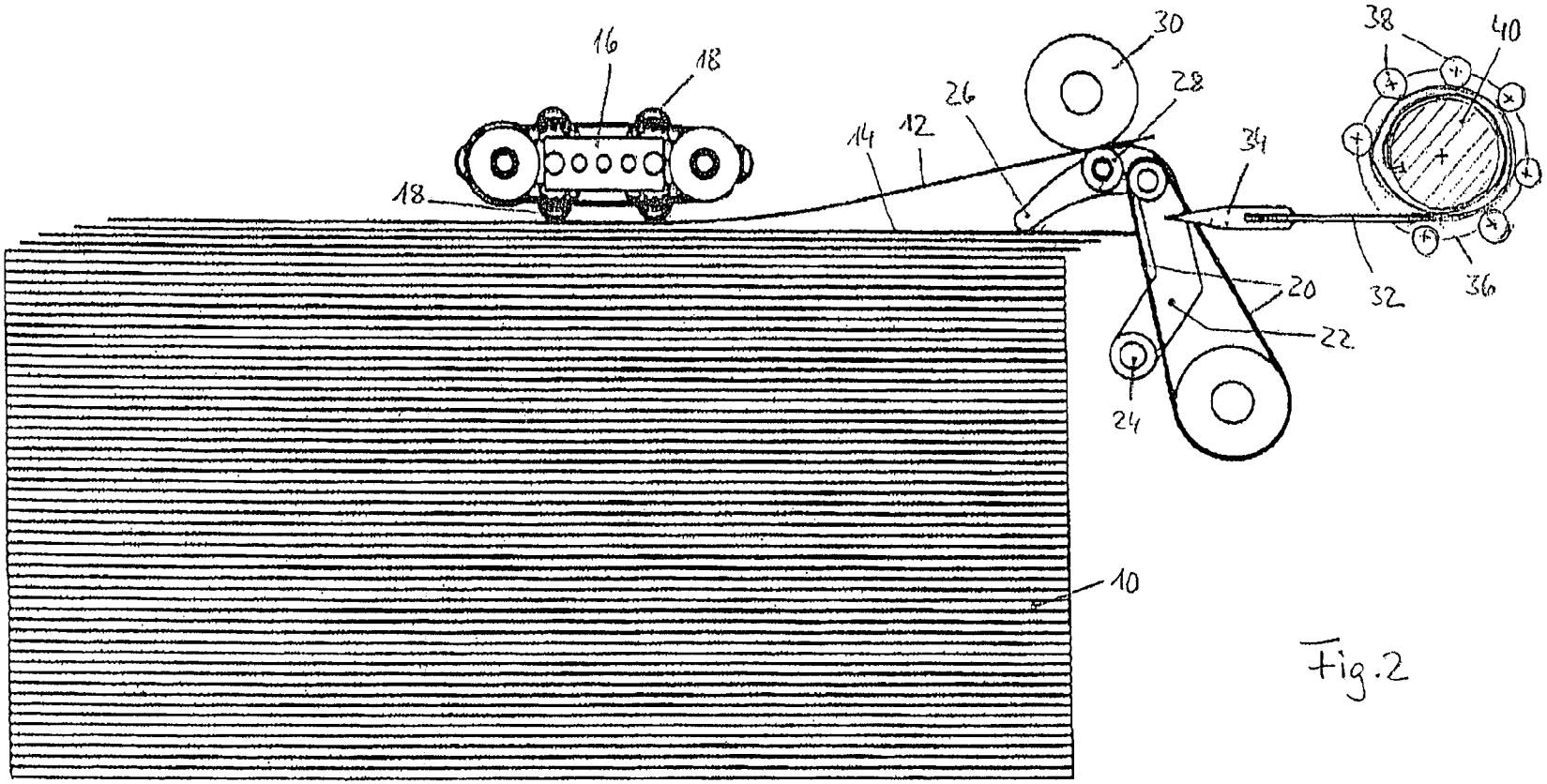
FIG. 2 shows a side view of the device with retracted band.

As soon as a sensor detects that the leading edge of the uppermost sheet 12 has been raised sufficiently, the grasping elements 22 are actuated in order to hold the second sheet 14 on the stack 10 and jam the uppermost sheet 12 between the pressure rolls 28 and the puller rolls 30 as shown in FIG. 2. The advance mechanism 16 is then lifted from the uppermost sheet 12 of the stack, the uppermost sheet 12 is pulled off by the mechanically driven puller rolls 30 and the bands 32 are advanced at high speed from their resting position shown in FIG. 2 toward the left against the stack 10. In the process the tips 34 penetrate into the gap between the uppermost sheet 12 and the following sheet 14 and the bands 32 are inserted across the entire length of the stack 10 between the uppermost sheet 12 and the following sheet 14 as shown in FIG. 3.

Since two bands 32 at some distance from each other are inserted between the uppermost sheet 12 and the following sheet 14, the uppermost sheet 12 is detached from the following sheet 14 across its entire area. When the uppermost sheet 12 is pulled off, it essentially rests on the bands 32 and not on the following sheet 14, thereby substantially reducing the friction between the uppermost sheet 12 and the following sheet 14 and avoiding the generation of an electrostatic charge. If there is some residual friction and if a small electrostatic charge is generated, it is discharged via the electrically conductive bands 32, for which purpose the latter are suitably grounded, e.g. via the band core 40 and the shaft 42.

Figure 3:
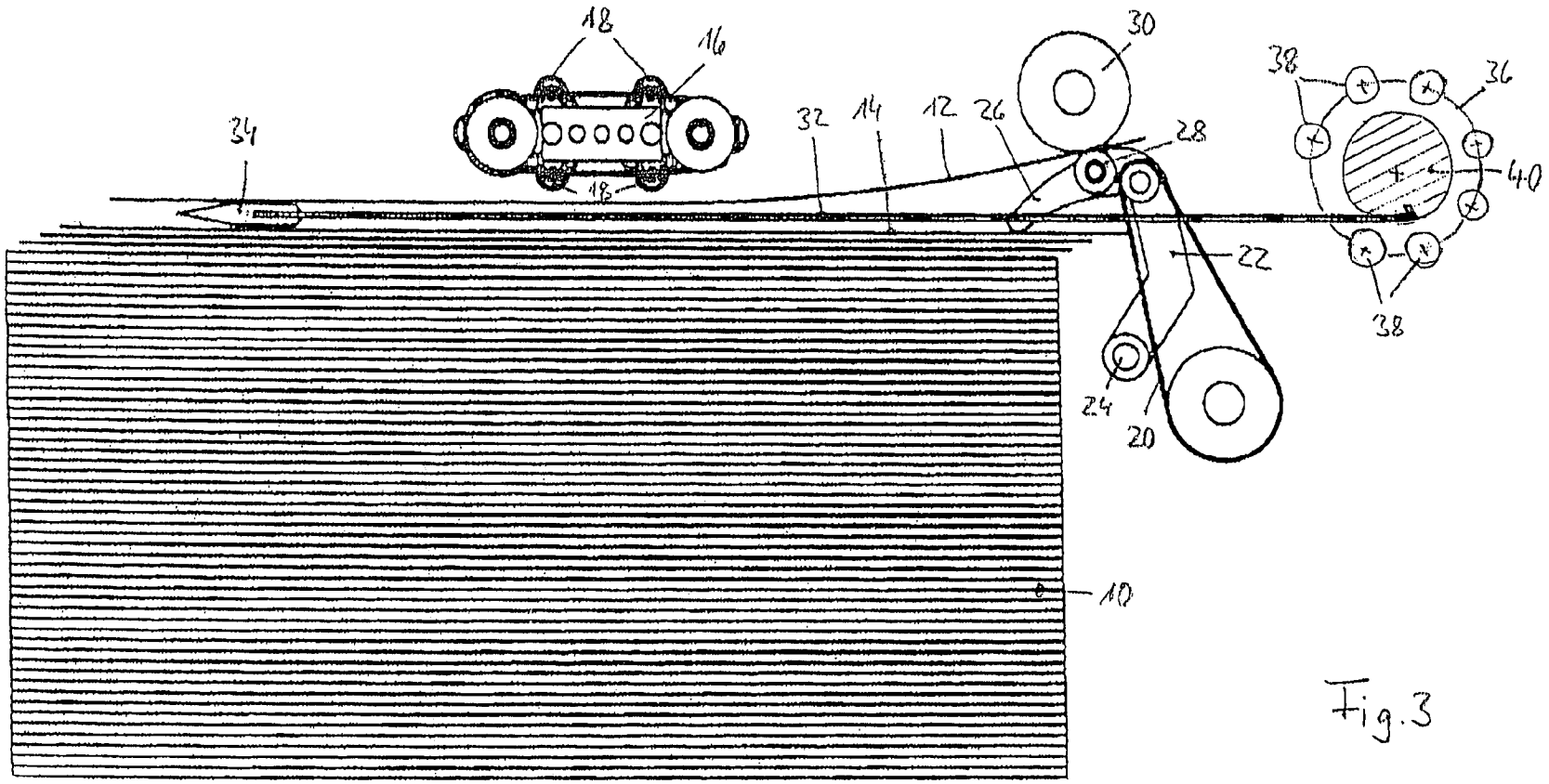
FIG. 3 shows the respective view with the band inserted.

As soon as the bands 32 have taken up their final position shown in FIG. 3, in which they have just separated the uppermost sheet 12 from the following sheet 14, the bands 32 are again retracted and wound up until they reach the rest position shown in FIG. 2, ready for the next sheet-separation cycle. The bands 32 are inserted between the uppermost sheet 12 and the following sheet 14 at great speed so that the uppermost sheet 12 is separated as quickly as possible from the second sheet 14 after its leading edge has been grasped by the pressure rolls 28 and the puller rolls 30. The bands 32 are rewound to their resting position also at great speed, avoiding thus any delay in the sheet-separation process.

I claim:

1. A device for separating individual sheets of a print medium to be fed into an office machine or similar equipment in which sheets are kept in a stack, comprising:

a device for raising at least one edge of an uppermost sheet of the stack from a following sheet of the stack, a device for pulling the uppermost sheet off the stack, and a device for feeding the pulled sheet into the office machine, at least one separating element comprising a band, wherein the separating element is designed to be moved into a gap created between the raised edge of the uppermost sheet and a corresponding edge of the following sheet and can be inserted between the uppermost sheet and the following sheet, and a band housing into which the band can be wound up.

2. The device according to claim 1, wherein a leading edge of the uppermost sheet pointing in the direction it is pulled off is raised off the following sheet, wherein the band housing is in front of the leading edge of the stack pointing in the direction it is pulled, and wherein the band can be inserted against the direction it is pulled off between the uppermost sheet and the following sheet.

3. The device according to claim 1, wherein the device for raising at least one edge of an uppermost sheet of the stack comprises an advance mechanism that engages the uppermost sheet and moves the uppermost sheet against at least one endlessly circulating belt which raises the edge of the uppermost sheet.

4. The device according to claim 1, wherein the band is a steel band of low material strength whose cross-section profile results in an axial stiffening of the band.

5. The device according to claim 4, wherein the band has a tip that glides smoothly.

6. The device according to claim 1, wherein at least one band is sufficiently long to be inserted across the entire length of the stack in the direction it is pulled off.

7. The device according to claim 1, wherein there are two bands on both sides of the device for raising the uppermost sheet and located at a certain distance from it.

8. The device according to claim 1, wherein at least one band is electrically conductive or has an electrically conductive coating and is grounded.

9. The device according to claim 1, wherein the perimeter area of the band housing has little gliding resistance.

10. The device according to claim 1, wherein the perimeter area of the band housing is formed by a ring of rolls that can be rotated freely.

11. The device according to claim 1, wherein at least one band can be retracted into the band housing on a coaxial band core.

12. The device according to claim 1, wherein a band core or band cores rest on a mechanically driven shaft.

13. The device according to claim 1, wherein at least one grasping element on the side of the stack pointing into the direction it is pulled can be moved between the raised edge of the uppermost sheet and the following sheet and wherein there is at least one grasping element that is offset vertically to the direction it is pulled against the at least one band.

* * * * *